United States Patent [19]

Smerke, II et al.

[11] Patent Number: 4,736,939

[45] Date of Patent: Apr. 12, 1988

[54] ENVELOPE TRANSPORT GUIDE

[76] Inventors: John J. Smerke, II, 725 Abbey La., Lansdale, Pa. 19446; Raymond D. DiSandro, 688 Sunnyvale Ave., Audubon, Pa. 19403

[21] Appl. No.: 825,323

[22] Filed: Feb. 3, 1986

[51] Int. Cl.[4] ..... B65H 29/00

[52] U.S. Cl. ..... 271/184; 271/225; 271/251

[58] Field of Search ..... 271/184, 185, 225, 250, 271/251

[56] References Cited

U.S. PATENT DOCUMENTS

| | | | |
|---|---|---|---|
| 3,220,569 | 11/1965 | Willits | 271/185 X |
| 3,779,546 | 12/1973 | Wojtowicz | 271/184 X |
| 3,815,898 | 6/1974 | Haifley | 271/185 X |
| 3,946,879 | 3/1976 | Jensen | 271/185 X |
| 4,047,712 | 9/1977 | Burkhardt | 271/185 X |
| 4,238,066 | 12/1980 | Brooke | 271/184 X |
| 4,273,491 | 6/1981 | Roux | 271/185 X |

*Primary Examiner*—Richard A. Schacher

*Attorney, Agent, or Firm*—Paul & Paul

[57] ABSTRACT

An envelope transport guide is disclosed that organizes opened and emptied envelopes from an envelope opening machine. The guide has an entry surface coplanar with the pathway of the moving envelopes, and adjacent the opening machine for accepting each envelope. The envelopes turn, under the force of gravity, around some guiding means and slide off the entry surface into an organized stack in an angled collection receptacle.

4 Claims, 1 Drawing Sheet

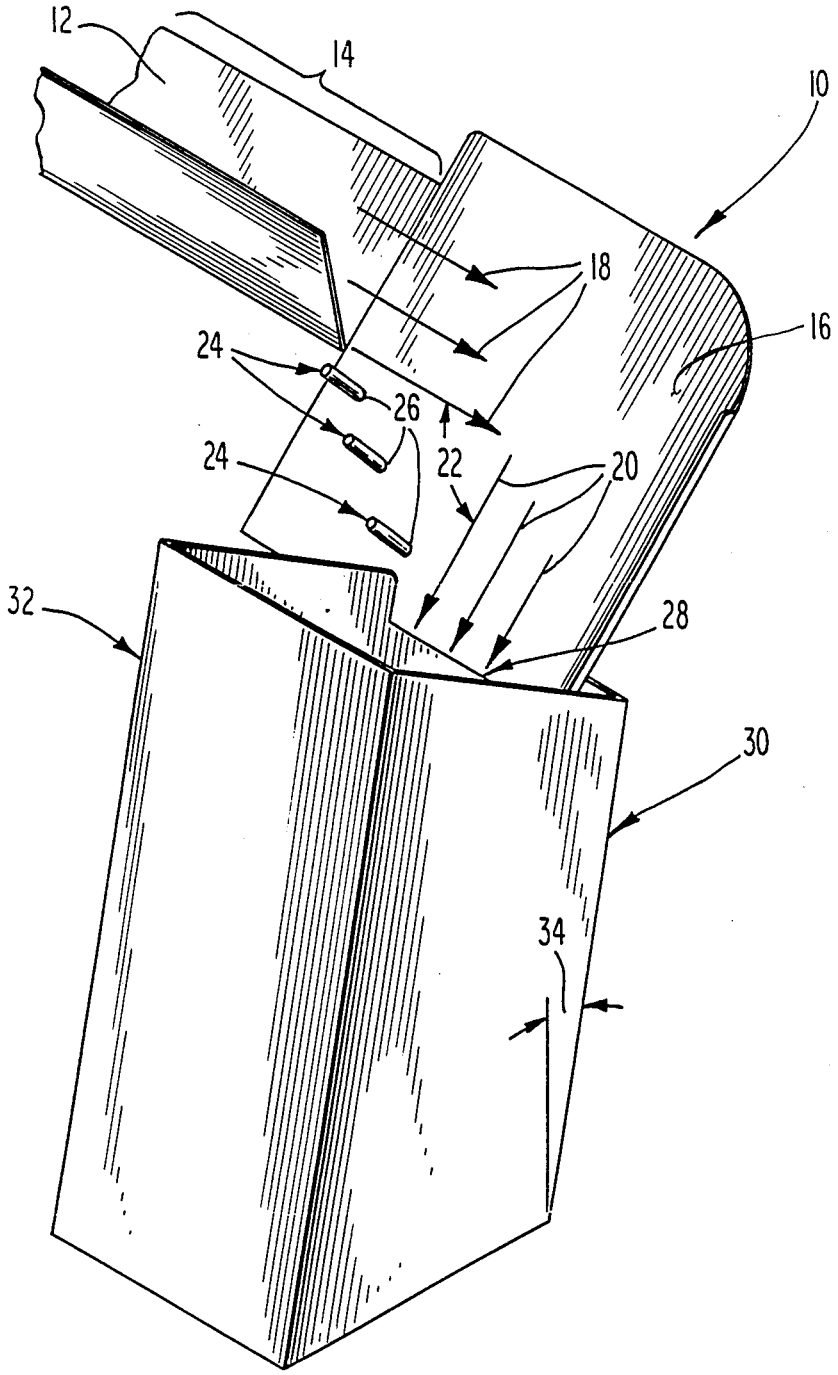
12
14
10
18
16
24
26
24
22
20
32
28
30
34

ENVELOPE TRANSPORT GUIDE

SUMMARY OF THE PRESENT INVENTION

The present invention relates to a guide for the collection of envelopes. In particular, the present invention relates to an envelope transport guide that organizes opened and emptied envelopes from an envelope opening machine.

BACKGROUND OF THE INVENTION

Many businesses conduct a tremendous number of transactions, either sending or receiving materials, by mail. Although the containers for most of these mail transactions are merely envelopes, when someone has sent money, or a check, to the business in the envelope, it becomes very important to carefully ensure the emptying of each of these envelopes before they are discarded. One common method of emptying envelopes is to use a separate worker at each distinct stage of the process. Then, for instance, there would be one person to take the contents out of each envelope and then another person to inspect that the envelope was actually empty before it was discarded. As automation has advanced, various forms of machinery and mechanized process have taken over these laborious tasks, saving substantial time and money.

Machines that will very neatly and quickly slit open the tops of the envelopes are now commonly employed in businesses that must handle a great deal of mail. Also employed are machines that can open an envelope using suction cups on either side, and permit a visual inspection of the inside of each envelope. In a continuous feed arrangement, this type of machinery can process a tremendous number of envelopes in a relatively short period of time. However, as a final check to ensure that every check has been removed from its envelope before the envelopes are discarded, a back-up process known as "candling" is commonly employed. In the process of candling, each envelope is backlighted and visually inspected to ensure that it is empty. This process has been unnecessarily complicated, however, because the empty envelopes which must be inspected in this manner come off the feed line of the feeding conveyor to a waiting area for the candling operations. The envelopes coming off the feed line are typically inter-mixed and organized indiscriminately to such an extent that excessive time is required to organize them. The instant invention can easily be adapted to operate in conjunction with most commercial automatic openers. When the present invention is employed, all envelopes coming off the feed line of the feeding conveyor are formed into a neat, compact stack. In such a state, the envelopes are ready to be sequentially backlighted in a candling procedure, or any other similar process.

OBJECTS OF THE PRESENT INVENTION

It is an object of the invention to provide a labor-saving device that can be easily adapted to existing office machinery.

It is a further object of the invention to provide a labor-saving device that can be quickly and economically manufactured.

It is a still further object of the invention to provide a labor-saving device that provides an organized stack of envelopes.

These and other objects and advantages of the present invention will be readily apparent to those skilled in the art by reading the following brief description of the drawings, detailed description of the preferred embodiment and the appended claims.

According to the present invention, there is provided an envelope transport guide for attachment adjacent to the output end of an envelope feeding conveyor which feeds envelopes off the conveyor on an angle of approximately 45 degrees, which transport guide has an entry surface adjacent to the conveyor and coplanar with the travel of envelopes on the conveyor; guiding means for redirecting the path of the envelopes through an angle on said entry surface thereby defining a redirected path; and, a collection means adjacent to the terminus of said redirected path which collection means is capable of accumulating a stack of envelopes.

According to the preferred embodiment of the present invention, there is provided an envelope transport guide for attachment adjacent to the output end of an envelope feeding conveyor which feeds envelopes off the conveyor on an angle of approximately 45 degrees, which transport guide has an entry surface adjacent to the conveyor and coplanar with the plane of travel of envelopes on the conveyor; guiding means comprising an array of pegs projecting perpendicularly from said entry surface at a plurality of locations on said surface, which array will allow the force of gravity to change the direction of travel of envelopes on said surface by 90 degrees; and, a collection means comprising a rectangular receptacle of suitable dimensions which is inclined at an angle of between 21 and 27 degrees from the vertical.

DETAILED DESCRIPTION OF THE INVENTION

With reference to the FIGURE, the present invention provides an envelope transport guide, shown generally as (10) which is located adjacent to the output end (12) of an envelope feeding conveyor (14).

Envelopes exiting the output end (12) of the envelope feeding conveyor (14) are received onto the entry surface (16) of the envelope transfer guide (10). The entry surface (16) is coplanar with the plane of travel of envelopes, represented by the arrows labeled (18) in the FIGURE.

Guiding means are provided for redirecting the path of envelopes from the plane represented by the arrows (18) to a redirected path, as represented by the arrows (20) in the FIGURE. Such redirected path varies by an angle shown as (22) in the FIGURE. In the preferred embodiment, this guiding means is provided by an array of pegs (24) extending perpendicularly from the entry surface (16) at a plurality of locations (26). Envelopes, under the influence of the force of gravity, and guided by the array of pegs (24), will enter upon the entry surface (16) in the direction of the arrows (18) and be redirected through the angle (22) in the direction of the arrows (20).

In the preferred embodiment, the angle (22) is 90 degrees and the envelopes are effectively turned onto one end. However, one skilled in the art will realize that this represents a matter of choice, and the angle chosen and the final orientation of the envelopes can vary greatly without varying from the scope of the present invention.

The guiding means of the present invention can also be varied. Although an array of pegs (24) fixedly attached to the entry surface (16) is shown, other guiding means may be employed. Envisioned in this regard is a greater plurality of pegs or a one-piece curved bracket or a continuous fence which may be fixedly attached or integrally formed with the entry surface (16).

Finally, it should be apparent that although the present invention advantageously employs the force of gravity to orient and accumulate envelopes, any positive force could also be employed in transporting turning and stacking envelopes in this manner.

At the lower terminus (28) of the entry surface (16), the envelope transport guide (10) is provided with a collection means (30). In the preferred embodiment, said collection means (30) comprises a rectangular receptacle (32) of a length suitable for the collection of an appropriate number of envelopes and of dimensions large enough to accomodate such envelopes. In order to keep the accumulating envelopes in a proper order, the collection means should be set at a slight angle (34) from the vertical. Without intending the invention to be narrowed thereto, the inventors of the present invention have found that angles of 21 to 27 degrees are appropriate to the practice of the present invention. In place of the collecting receptacle of the prior art, which is typically a circular bin in which envelopes are deposited in disordered orientation requiring an additional step of labor, and offer the services of an additional worker, to align the envelopes for a candling step or delivery to a candling machine, the receptacle (32) of the present invention automatically collects the envelopes in alignment, thus eliminating such an align step.

In the preferred embodiment, the receptacle (32) of the present invention is open-topped and of rectangular, parallelepipedal shape. Further, the receptacle (32) has interior horizontal cross-sectional shape so as to receive emptied envelopes falling into the receptacle (32) from the terminus (28) of the envelope transport guide (10) only in lengthwise parellism and to permit them to stack themselves flatwise in an ordered parallel array in the receptacle.

The horizontal cross-sectional interior shape of the receptacle (32) of the present invention is a rectangular oblong. This is so that a standard-sized envelope will always lie in the receptacle with its long edge parallel to the long side of the oblong shape. At the same time, the transverse dimension of the oblong shape should be narrow enough to prevent cross-wise deposition of a falling envelope, yet wide enough to permit the stacked envelopes to be readily removed from the receptacle by the handful. It is of no consequence to the candling machine that the envelopes are reversed or inverted as long as none are in cross-wise position.

It should be noted also that the envelope transport guide of the present invention not only succeeds in eliminating the laborious step of aligning the envelopes for transfer to the candling machine, often the function of an auxillary worker, but that this is achieved without the use of any additional power requirement other than the force of gravity.

One skilled in the art will appreciate that the envelope transport guide (10) and the receptacle (32) of the present invention can be constructed of a variety of materials, and certainly need not all be constructed of the same material. For ease of fabrication, wood and various metals can be employed. However, in large scale production most, if not all, parts could be fashioned from some form of plastic.

Other features, advantages and specific embodiments of this invention will become readily apparent to those exercising ordinary skill in the art after reading the foregoing disclosures. These specific embodiments are within the scope of the claimed subject matter unless otherwise expressly indicated to the contrary. Moreover, while specific embodiments of this invention have been described in considerable detail, variations and modifications of these embodiments can be effected without departing from the spirit and scope of this invention as disclosed and claimed.

What is claimed is:

1. An envelope transport guide for attachment adjacent to the output end of an envelope feeding conveyor which feeds envelopes off the conveyor, which transport guide has an entry surface adjacent to the conveyor and coplanar with the plane of travel of envelopes on the conveyor; guiding means comprising an array of pegs projecting perpendicularly from said entry surface at a plurality of locations on said surface, which array comprises means for allowing the force of gravity to change the direction of travel of envelopes on said surface by substantially a right angle while maintaining the envelopes in said plane of travel of the entry surface; and, a collection means comprising a rectangular receptacle of suitable dimensions which is inclined at an angle of between 21 and 27 degrees from the vertical.

2. An envelope transport guide as in claim 1 wherein said rectangular receptacle is open-topped and of rectangular parallelepipedal shape such as to receive envelopes falling into it only in lengthwise parallelism and to permit them to stack themselves in ordered parallelism therein, with the horizontal cross-sectional, internal shape of said receptacle being a rectangular oblong such that a standard-sized envelope will always lie in said receptacle with its long edge parallel to the long dimension of said oblong shape, and the transverse dimension of said oblong shape being narrow enough to prevent crosswise deposition of a falling envelope, but wide enough to permit stacked envelopes to be readily removed from said receptacle by the handful.

3. The envelope transport guide of claim 1, wherein the envelopes are fed off the conveyor at an acute angle relative to the vertical.

4. An envelope transport guide for attachment adjacent to the output end of an envelope feeding conveyor which feeds envelopes off the conveyor, which transport guide has an entry surface adjacent to the conveyor and coplanar with the plane of travel of envelopes from the conveyor; guiding means for redirecting the path of the envelopes through an angle on said entry surface while maintaining the envelopes in said plane of travel of the entry surface, thereby defining a redirected path; and, a collection means adjacent to the terminus of said redirected path which collection means is capable of accumulating an organized stack of envelopes; wherein said guiding means comprises an array of pegs projecting perpendicularly from said entry surface at a plurality of locations on said surface, which array will allow the force of gravity to change the direction of travel of envelopes.

* * * * *